US009964369B2

(12) United States Patent
Garrow

(10) Patent No.: US 9,964,369 B2
(45) Date of Patent: May 8, 2018

(54) AUTO-LOADING FIREARM

(71) Applicant: Michael Lee Garrow, Oceanside, CA (US)

(72) Inventor: Michael Lee Garrow, Oceanside, CA (US)

( * ) Notice: Subject to any disclaimer, the term of this patent is extended or adjusted under 35 U.S.C. 154(b) by 0 days. days.

(21) Appl. No.: 15/008,930

(22) Filed: Jan. 28, 2016

(65) Prior Publication Data

US 2016/0252316 A1 Sep. 1, 2016

Related U.S. Application Data

(60) Provisional application No. 62/176,787, filed on Feb. 26, 2015.

(51) Int. Cl.

| | |
|---|---|
| ***F41A 3/62*** | (2006.01) |
| ***F41A 3/44*** | (2006.01) |
| ***F41A 19/30*** | (2006.01) |
| *F41A 5/18* | (2006.01) |

(52) U.S. Cl.

CPC ..... *F41A 3/62* (2013.01); *F41A 3/44* (2013.01); *F41A 19/30* (2013.01); *F41A 5/18* (2013.01)

(58) Field of Classification Search

CPC ..... F41A 3/36–3/52; F41A 3/62; F41A 19/30; F41A 5/18

See application file for complete search history.

(56) References Cited

U.S. PATENT DOCUMENTS

| | | | |
|---|---|---|---|
| 639,421 | A | 12/1899 | Mauser |
| 918,760 | A | 4/1909 | Mauser |
| 943,949 | A | 12/1909 | Mauser |
| 987,584 | A | 3/1911 | Mauser |

(Continued)

FOREIGN PATENT DOCUMENTS

| | | | | |
|---|---|---|---|---|
| AT | 295355 B | * | 12/1971 | ..... F41A 3/46 |
| DE | 105619 | | 10/1899 | |

(Continued)

OTHER PUBLICATIONS

Machine translation of DE 3,424,761 A1, Espacenet.*

(Continued)

*Primary Examiner* — Stephen Johnson
*Assistant Examiner* — Joshua T Semick
(74) *Attorney, Agent, or Firm* — Bennet K. Langlotz; Langlotz Patent & Trademark Works, Inc.

(57) ABSTRACT

An auto-loading firearm has a frame defining a bolt passage, a bolt operable to reciprocate between a battery position and a retracted position, a barrel defining a gas aperture, an energy transmission facility having a first end communicating with the gas aperture and an opposed second end, the bolt having a bolt body and a bolt key movable with respect to the bolt body between a forward position and a rearward position, the bolt key operably engaging the second end of the energy transmission facility when the bolt is in the battery position, the bolt including a latch element operably engaged to the bolt key having a locked position to prevent reciprocation of the bolt, and an unlocked position in which reciprocation of the bolt is enabled, and the latch element being responsive to rearward motion of the bolt key to move from the locked position to the unlocked position.

29 Claims, 9 Drawing Sheets

(56) References Cited

U.S. PATENT DOCUMENTS

| | | | | |
|---|---|---|---|---|
| 1,047,672 | A | 12/1912 | Mauser | |
| 2,089,671 | A | 8/1937 | Stecke | |
| 2,116,141 | A | 5/1938 | Browning | |
| 2,951,424 | A | 9/1960 | Stoner | |
| 3,101,648 | A | 8/1963 | Walther | |
| 3,198,076 | A | 8/1965 | Stoner | |
| 3,407,702 | A | 10/1968 | Cermak et al. | |
| 3,618,457 | A | 11/1971 | Miller | |
| 3,675,534 | A | 7/1972 | Beretta | |
| 3,998,126 | A | 12/1976 | Rudd | |
| 4,028,994 | A | 6/1977 | Ferluga | |
| 4,048,901 | A | 9/1977 | Ghisoni | |
| 4,095,507 | A | 6/1978 | Close | |
| 4,135,434 | A * | 1/1979 | Hurlemann | F41A 3/46 89/181 |
| 4,213,261 | A | 7/1980 | Claypool | |
| 4,232,583 | A | 11/1980 | Harrison | |
| 4,358,986 | A | 11/1982 | Giorgio | |
| 4,440,065 | A | 4/1984 | Hupp | |
| 4,448,109 | A | 5/1984 | Johnson | |
| 4,475,438 | A | 10/1984 | Sullivan | |
| 4,649,800 | A | 3/1987 | Tessler | |
| 4,765,224 | A | 8/1988 | Morris | |
| 4,817,496 | A | 4/1989 | Zedrosser | |
| 4,909,129 | A | 3/1990 | Reynolds | |
| 4,922,640 | A | 5/1990 | Toombs | |
| 5,351,598 | A | 10/1994 | Schnetz | |
| 5,388,500 | A | 2/1995 | Petrovich | |
| 5,429,034 | A | 7/1995 | Badali et al. | |
| 5,447,092 | A | 9/1995 | Dobbins | |
| 5,448,940 | A | 9/1995 | Schnetz et al. | |
| 5,499,569 | A | 3/1996 | Schnetz | |
| 5,520,019 | A | 5/1996 | Schnetz | |
| 5,682,007 | A | 10/1997 | Dobbins | |
| 5,900,576 | A * | 5/1999 | Gabriel | F41A 3/46 89/187.01 |
| 5,983,774 | A | 11/1999 | Mihaita | |
| 6,079,138 | A | 6/2000 | Meaker | |
| 6,530,306 | B1 | 3/2003 | LaFleur | |
| 6,715,399 | B2 | 4/2004 | Barrett, Jr. | |
| 7,299,737 | B2 | 11/2007 | Hajjar et al. | |
| 7,311,032 | B2 | 12/2007 | Murello | |
| 7,448,307 | B1 | 11/2008 | Dalinov | |
| 7,571,671 | B2 * | 8/2009 | Engel | F41A 3/18 89/161 |
| 7,770,507 | B1 * | 8/2010 | Hajjar | F41A 3/46 89/188 |
| 7,775,149 | B2 | 8/2010 | Keeney et al. | |
| 8,117,958 | B2 | 2/2012 | Hochstrate et al. | |
| 8,245,626 | B2 | 8/2012 | Langevin | |
| 8,640,598 | B1 | 2/2014 | Jackson | |
| 9,513,076 | B2 * | 12/2016 | Kolev | F41A 3/12 |
| 2009/0101000 | A1 * | 4/2009 | Rawson-Harris | F41A 3/62 89/183 |
| 2010/0236395 | A1 | 9/2010 | Akhavan | |
| 2012/0152106 | A1 | 6/2012 | Langevin | |
| 2015/0330727 | A1 | 11/2015 | Kolev et al. | |

FOREIGN PATENT DOCUMENTS

| | | | | |
|---|---|---|---|---|
| DE | 945216 | | 6/1938 | |
| DE | 1124400 B | * | 2/1962 | F41A 3/12 |
| DE | 3424761 A1 | * | 1/1986 | F41A 3/46 |
| GB | 1224724 A | * | 3/1971 | F41A 3/46 |

OTHER PUBLICATIONS wikipedia.org, "Roller locked," https://en.wikipedia.org/wiki/Roller_locked, Last modified Jun. 3, 2015, Accessed Aug. 6, 2016.

Ian McCollum, "Do You Know Your HK's Parents?," http://www.thefirearmblog.com/blog/2013/01/01/do-you-know-your-hks-parents/, Published Jan. 1, 2013, Accessed Aug. 6, 2016.

Armeiro, "H&K History Article (Do You Know Your HK's Parents?)," http://www.ar15.com/forums/t_6_9/421676_Handamp_K_HISTORY_ARTICLE_Do_You_Know_Your HK_s_Parents_.html, Published Apr. 3, 2014, Accessed Aug. 6, 2016.

Trx, "Scratchbuilt roller locking," http://www.gunco.net/forums/151-build-yourself-forum-all-other-stuff/56890-scratchbuilt-roller-locking.html, Published Aug. 13, 2010, Accessed Aug. 6, 2016.

* cited by examiner

AUTO-LOADING FIREARM

CROSS-REFERENCE TO RELATED APPLICATION

This application claims the benefit of U.S. Provisional Patent Application No. 62/176,787 filed on Feb. 26, 2015, entitled "GAS DELAYED BLOWBACK FIREARM MECHANISM," which is hereby incorporated by reference in its entirety for all that is taught and disclosed therein.

FIELD OF THE INVENTION

The present invention relates to firearms, and more particularly to a delayed blowback system employed for operating the bolt of an auto-loading firearm.

BACKGROUND OF THE INVENTION

The most widely used methods of operation of automatic firearms are the gas, cylinder, piston system; the recoil actuated system; and the blowback or inertia block system. The conventional blow-back system is designed for weapons using lower power ammunition, such as a pistol or rim-fire weapons. In some applications, it would be desirable to use higher power magnum cartridges in a firearm with a blow-back system than is possible using a conventional design.

Therefore, a need exists for a new and improved auto-loading firearm that delays the operation of the blow-back system to enable the use of higher powered magnum cartridges. In this regard, the various embodiments of the present invention substantially fulfill at least some of these needs. In this respect, the auto-loading firearm according to the present invention substantially departs from the conventional concepts and designs of the prior art, and in doing so provides an apparatus primarily developed for the purpose of delaying the operation of the blow-back system to enable the use of higher powered magnum cartridges.

SUMMARY OF THE INVENTION

The present invention provides an improved auto-loading firearm, and overcomes the above-mentioned disadvantages and drawbacks of the prior art. As such, the general purpose of the present invention, which will be described subsequently in greater detail, is to provide an improved auto-loading firearm that has all the advantages of the prior art mentioned above.

To attain this, the preferred embodiment of the present invention essentially comprises a frame defining a bolt passage, a bolt within the bolt passage and operable to reciprocate therein between a battery position and a retracted position along a bolt axis, an elongated barrel connected to the frame, the barrel defining a gas aperture at an intermediate position along the length of the barrel, an energy transmission facility having a first end communicating with the gas aperture and an opposed second end, the bolt having a bolt body and a bolt key movable with respect to the bolt body between a forward position and a rearward position, the bolt key operably engaging the second end of the energy transmission facility when the bolt is in the battery position, the bolt including a latch element operably engaged to the bolt key, the latch element having a locked position in which the latch element operably engages the frame to prevent reciprocation of the bolt, and an unlocked position in which reciprocation of the bolt is enabled, and the latch element being responsive to rearward motion of the bolt key to move from the locked position to the unlocked position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
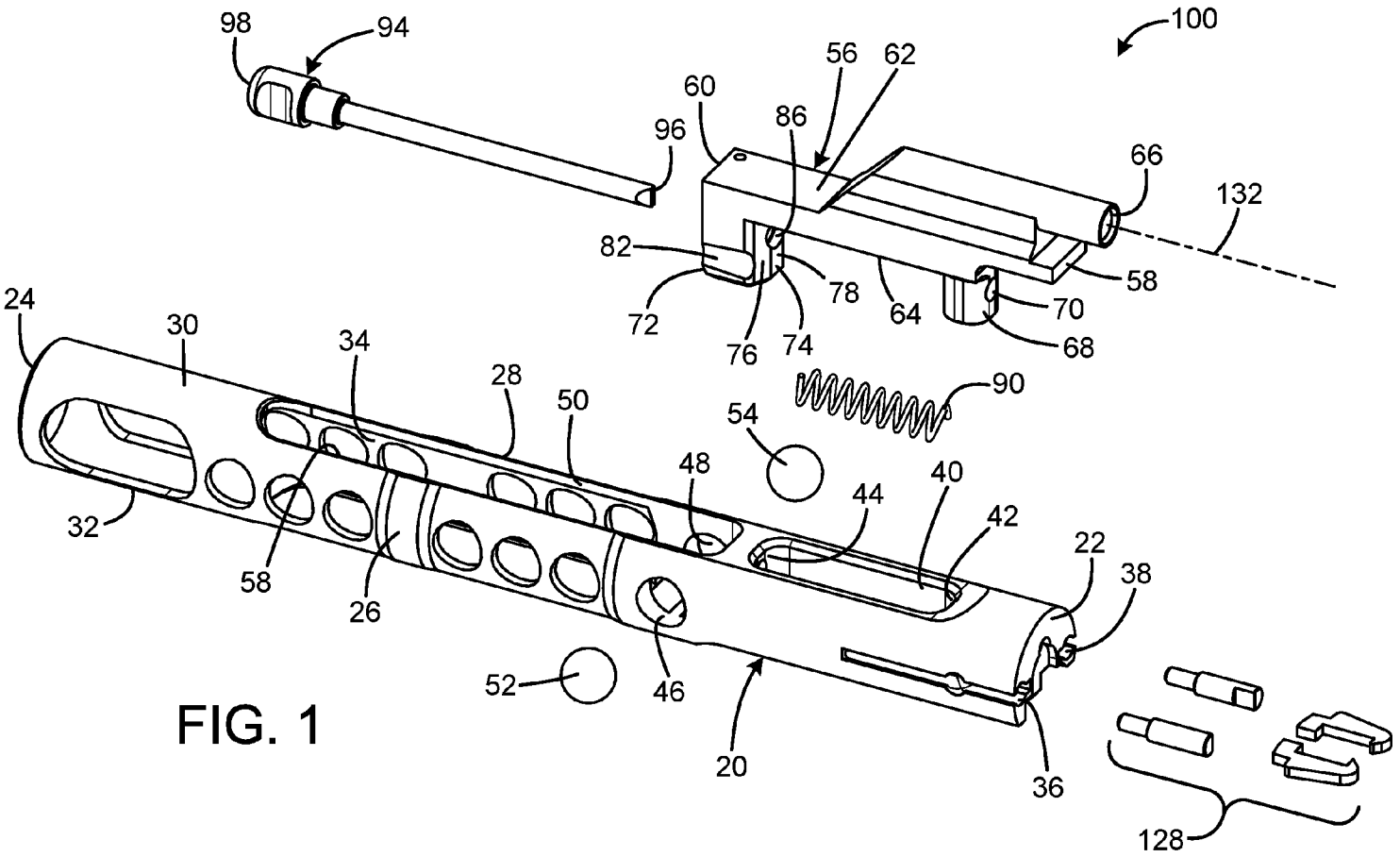
FIG. 1 is an exploded view of the current embodiment of the delayed blow-back system of the auto-loading firearm constructed in accordance with the principles of the present invention.

An embodiment of the auto-loading firearm of the present invention is shown and generally designated by the reference numeral 10.

Figure 2:
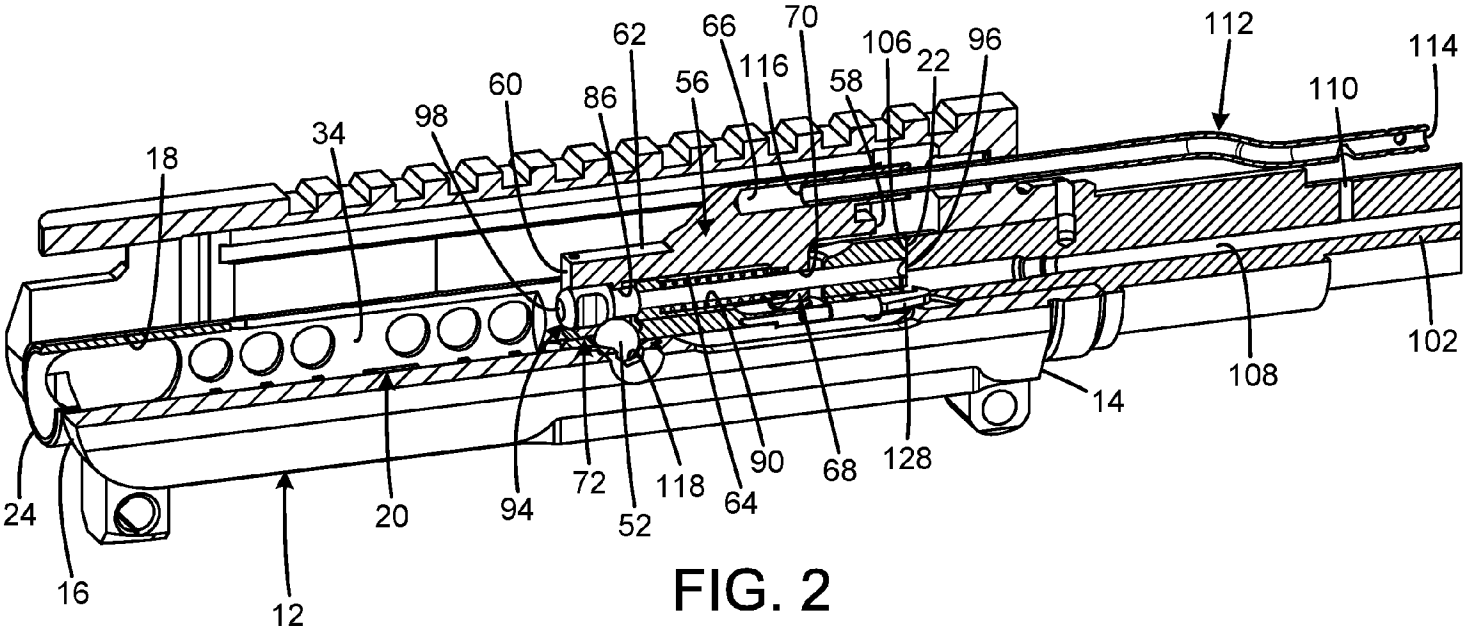
FIG. 2 is a rear isometric sectional view of the current embodiment of the upper receiver of the auto-loading firearm.
Figure 3A:
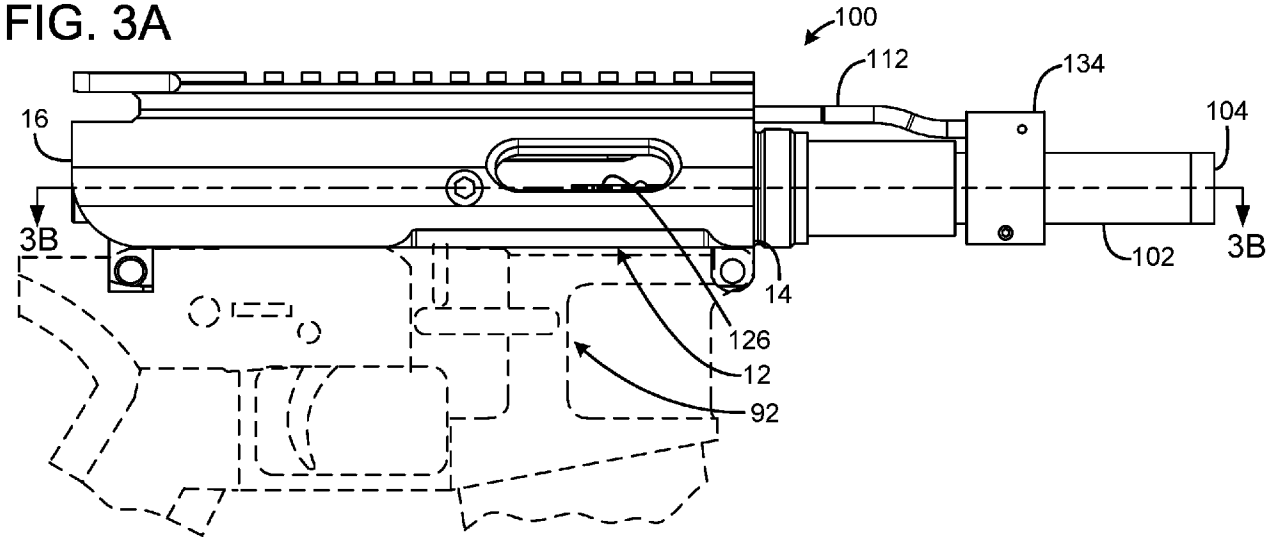
FIG. 3A is a right side view of the auto-loading firearm with the delayed blow-back system in the locked position.
Figure 3B:
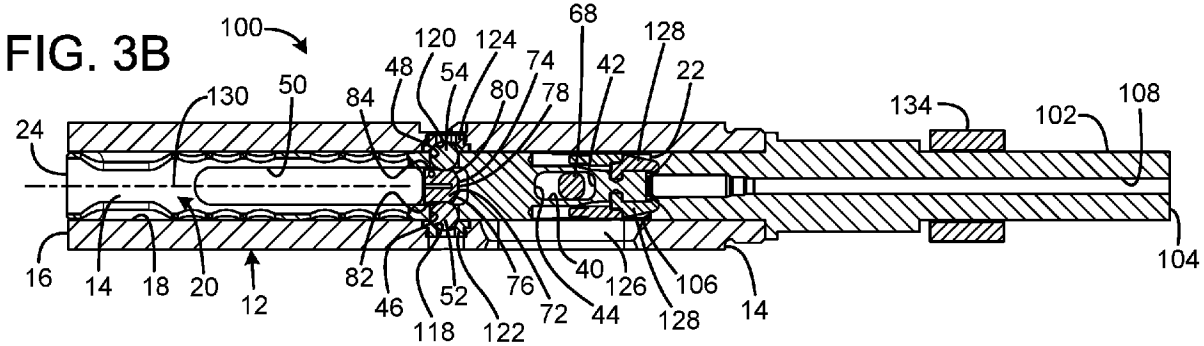
FIG. 3B is a top sectional view taken along line 3B-3B of FIG. 3A.
Figure 3C:
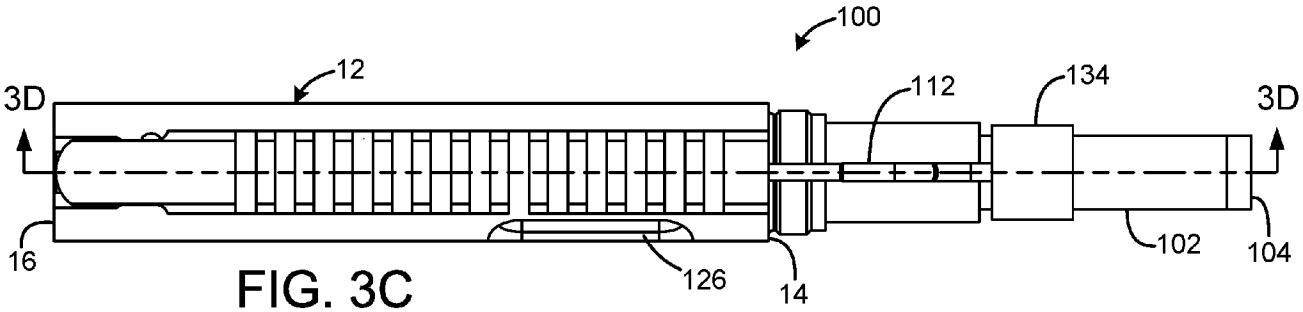
FIG. 3C is a top view of the upper receiver of the auto-loading firearm of FIG. 3A with the delayed blow-back system in the locked position.
Figure 3D:
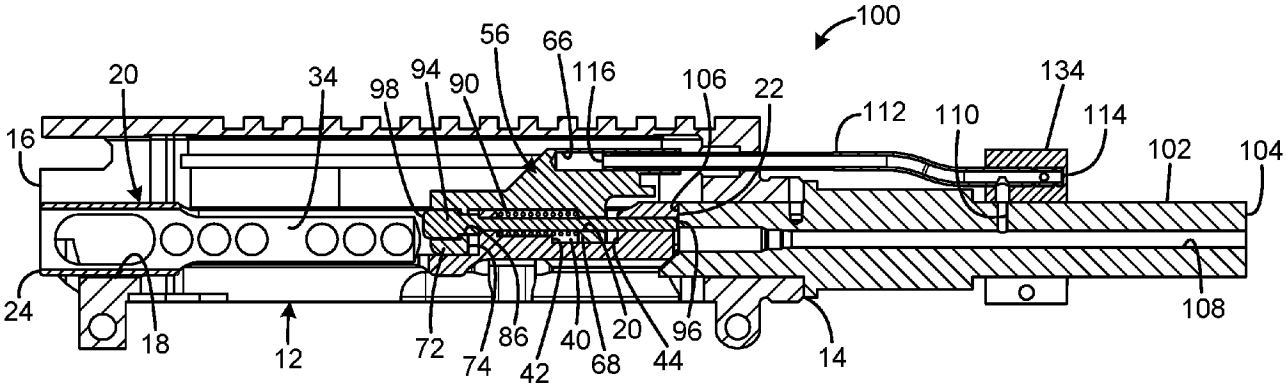
FIG. 3D is a side sectional view taken along line 3D-3D of FIG. 4C.
Figure 4A:
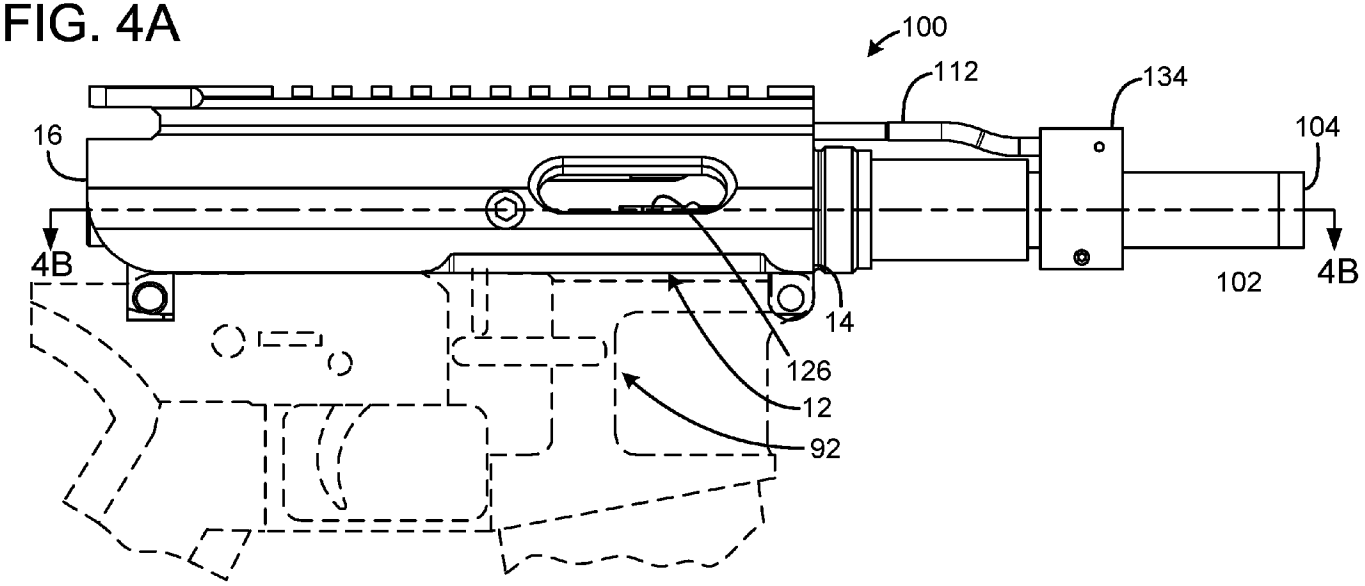
FIG. 4A is a right side view of the upper receiver of the auto-loading firearm of FIG. 3A with the delayed blow-back system in the initially unlocked position to permit recoil.
Figure 4B:
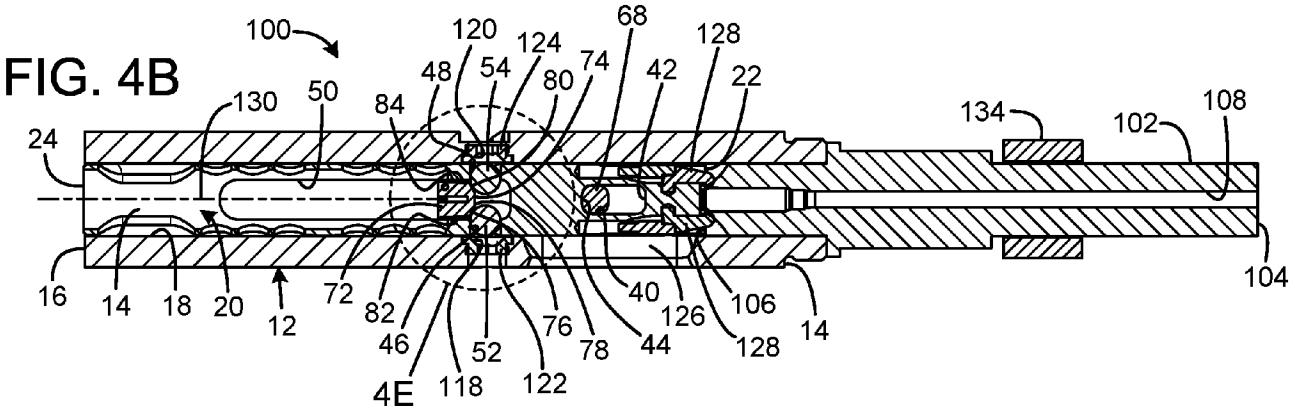
FIG. 4B is a top sectional view taken along line 4B-4B of FIG. 4A.
Figure 4C:
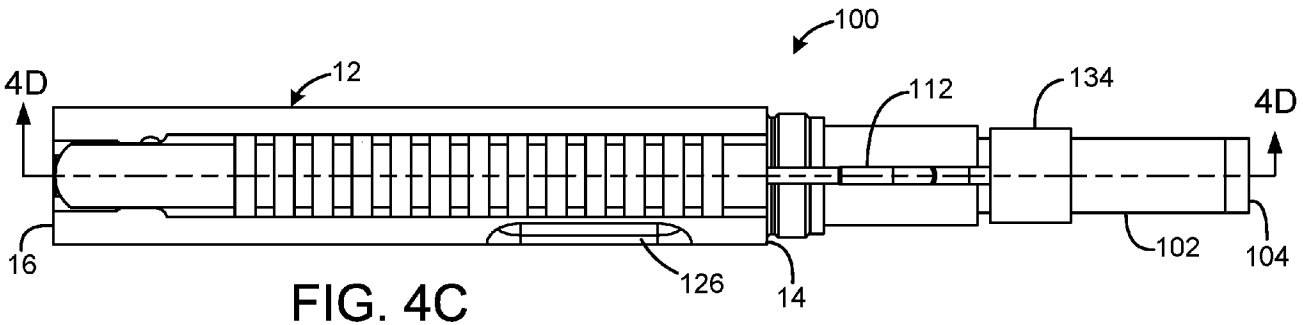
FIG. 4C is a top view of the upper receiver of the auto-loading firearm of FIG. 3A with the delayed blow-back system in the initially unlocked position to permit recoil.
Figure 4D:
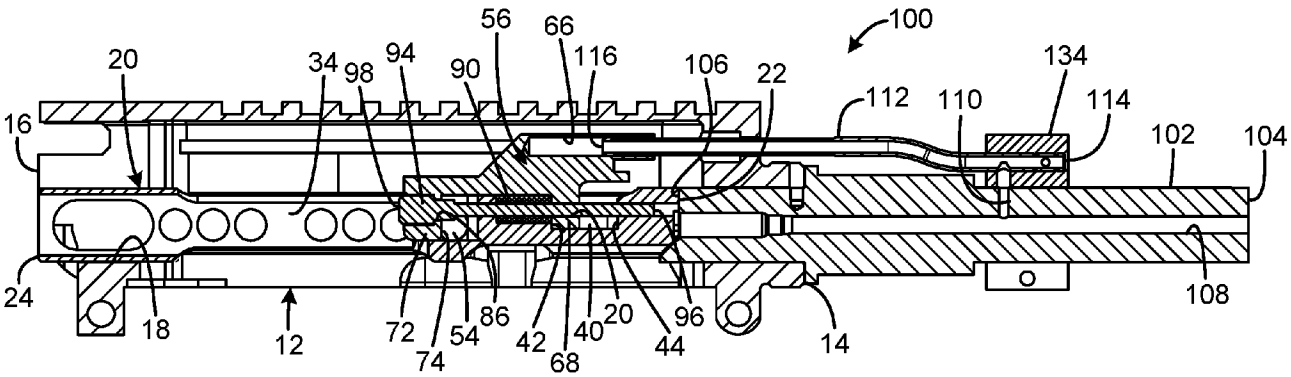
FIG. 4D is a side sectional view taken along line 4D-4D of FIG. 4C.
Figure 4E:
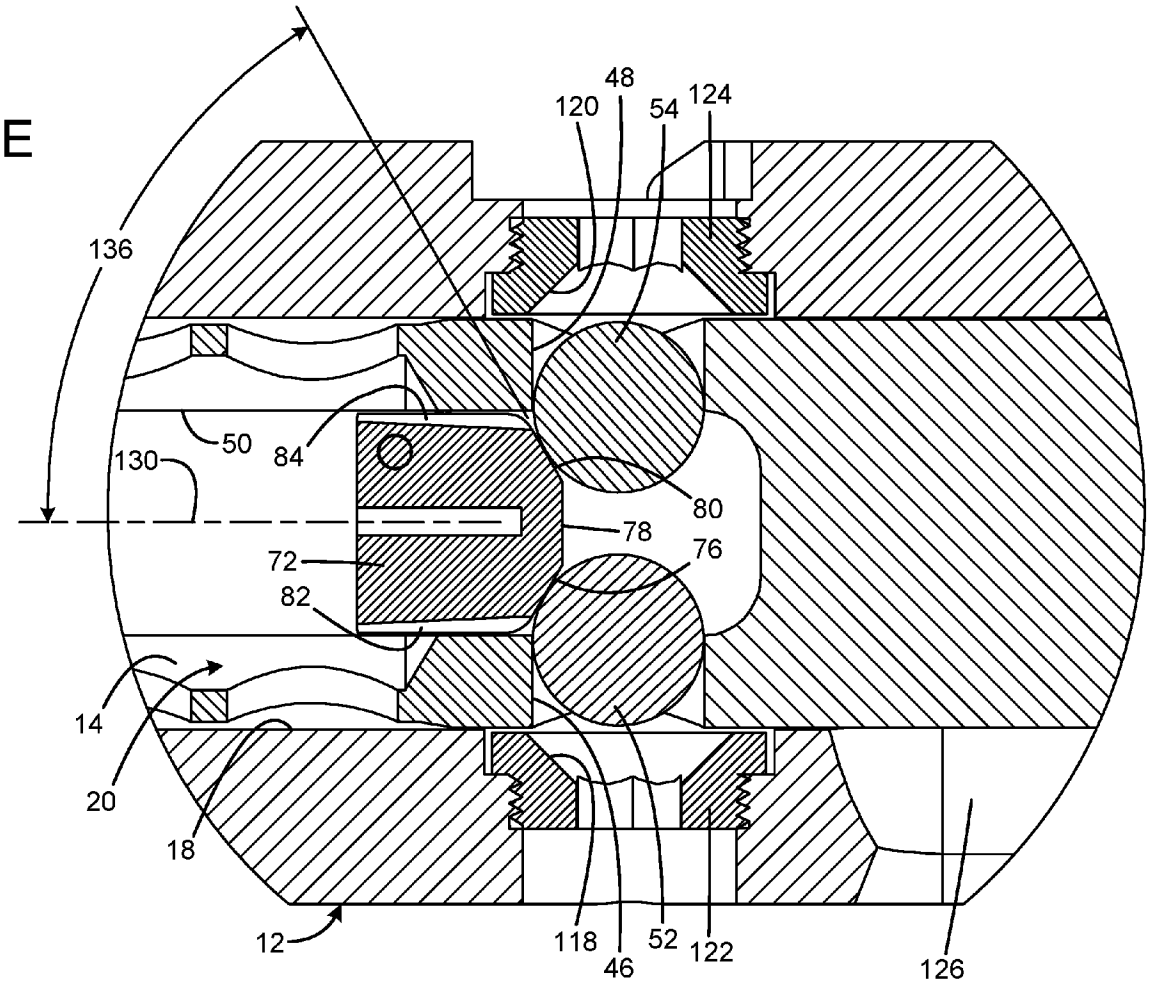
FIG. 4E is an enlarged view taken along the circle 4E of FIG. 4B
Figure 5A:
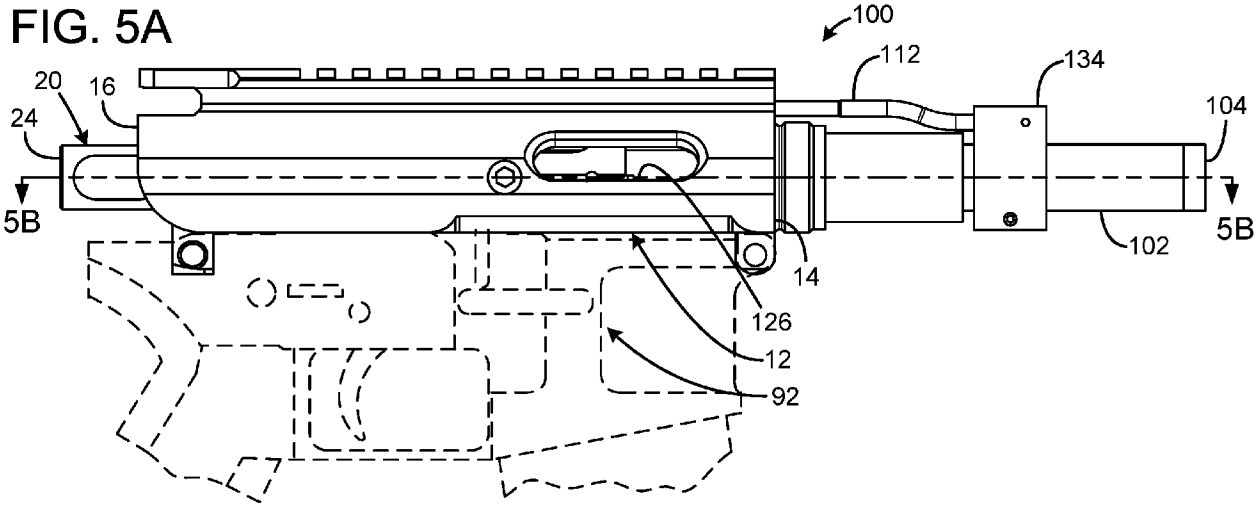
FIG. 5A is a right side view of the upper receiver of the auto-loading firearm of FIG. 3A with the delayed blow-back system in the full recoil position.
Figure 5B:
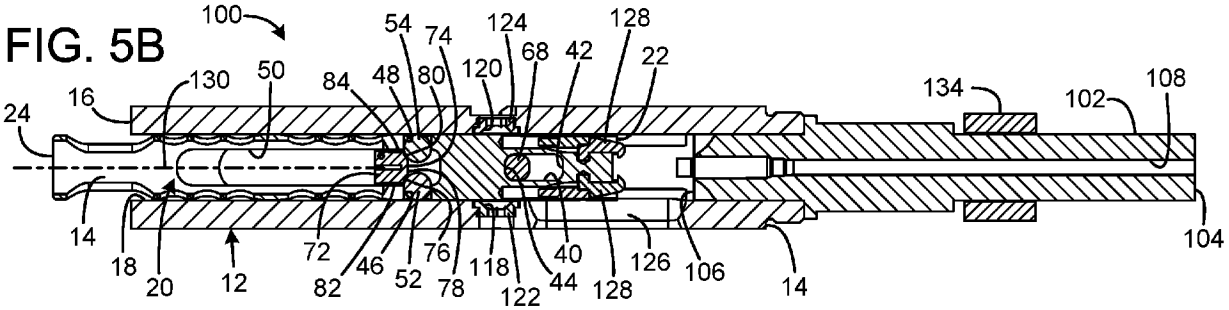
FIG. 5B is a top sectional view taken along line 5B-5B of FIG. 5A.
Figure 5C:
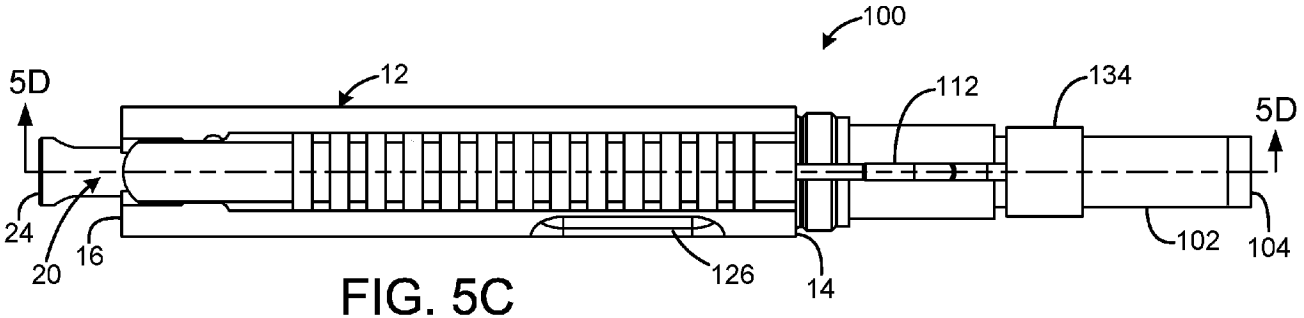
FIG. 5C is a top view of the upper receiver of the auto-loading firearm of FIG. 3A with the delayed blow-back system in the full recoil position.
Figure 5D:
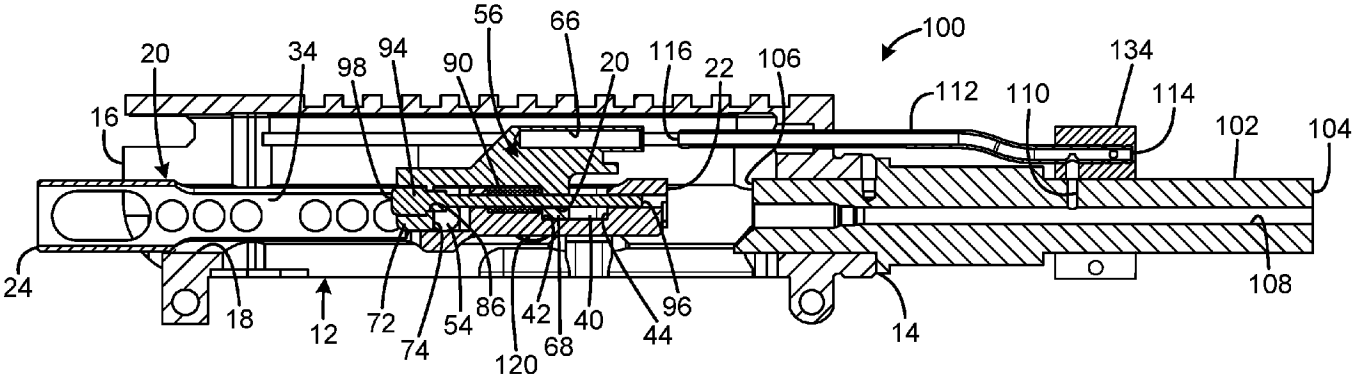
FIG. 5D is a side sectional view taken along line 5D-5D of FIG. 4C.

FIGS. 1-2 illustrate the improved delayed blow-back system 100 suitable for use with the improved auto-loading firearm 10 of the present invention. More particularly, the auto-loading firearm has an upper receiver/frame 12 (shown in FIG. 2) and a lower receiver 92 (shown in FIGS. 3A-5A). The upper receiver has a front 14, rear 16, and a longitudinal central bore 18 acting as a bolt passage defining a bolt axis 130 (shown in FIG. 3B). In the current embodiment, the upper receiver is similar to a conventional AR-15 pattern firearm, and the lower receiver is that of a conventional AR-15 pattern firearm.

A tubular bolt body 20 is slidably received within the central bore 18 of the upper receiver 12. The bolt has a front 22, rear 24, right side 26, left side 28, top 30, bottom 32, and a longitudinal central bore 34. The front sides of the bolt define a right extractor slot 36 and a left extractor slot 38 that receive extractors 128. The front top of the bolt defines a front guide slot 40 having a front 42 and a rear 44. The top of the bolt also defines a rear guide slot 50 located behind the front guide slot. A right aperture 46 and a left aperture 48 in the sides of the bolt communicate with the central bore 34 at the bottom of the rear guide slot. The right and left apertures are sized such that a right locking bearing 52 and a left locking bearing 54 can pass through the right and left apertures.

A bolt/gas key 56 having a front 58, rear 60, top 62, and a bottom 64 is slidably mounted to the top 30 of the bolt 20. A tubular gas bore is attached to the top front of the gas key. A rudder 68 having a bore 70 is attached to the bottom front of the gas key. A sear 72 is attached to the bottom rear of the gas key. The sear has a front 74 with a right angled portion 76, central flat portion 78, and left angled portion 80 (visible in FIGS. 3B, 4B, and 5B) that act as a wedge. The sear also has a right groove 82, a left groove 84 (visible in FIGS. 3B, 4B, and 5B), and a bore 86. The right and left grooves act as cam surfaces.

When the delayed blow-back system 100 is assembled, the gas key 56 has the rudder 68 slidably mounted within the front guide slot 40, and the sear 72 slidably mounted within the rear guide slot 50. The gas key is biased by pressure exerted by a firing pin spring 90 to the front of the limits of the rudder's travel within the front guide slot, which places the bolt 20 in the closed position. The firing pin spring is located between the rudder 68 and the rear 44 of the bolt 20 when the delayed blow-back system 100 is assembled.

A firing pin 94 having a front 96 and rear 98 receives the firing pin spring 90. The front of the firing pin passes through the bores 86 and 70 in the sear 72 and rudder 68 when the delayed blow-back system 100 is assembled. The bores 70, 86 enable the front of the firing pin to discharge a loaded cartridge (not shown).

An elongate barrel 102 having a front 104 (shown in FIG. 3A), rear 106, and longitudinal barrel bore 108 is attached to the front 14 of the frame/upper receiver 12. The barrel has a gas aperture/port 110 that communicates between the barrel bore and a gas block 134. The gas block provides an interface between the gas port and the front 114 of a gas tube 112, which acts as an energy transmission facility. The rear 116 of the gas tube terminates inside the upper receiver 12 inside the gas bore 66 of the gas key 56 with a slide fit.

FIGS. 3A-3D show the bolt 20 in the closed or battery position before firing. In this condition, the gas tube 112 has the front end 114 connected to the gas port 110 in the barrel 102 via a gas block 134, and the rear end 116 of the gas tube is ensconced in the gas bore 66 on the gas key 56. The rudder 68 of the gas key is biased by pressure exerted by firing pin spring 90 to the front end 42 of the front guide slot 40 in the bolt. The gas key remains in the locked position in the absence of gas discharge energy being transmitted by the gas tube energy transmission facility into the gas bore. In this position, the sear 72 urges the right locking ball bearing 52 and left locking ball bearing 54 to move in opposition out of the central bore 34 of the bolt through the right aperture 46 and left aperture 48. The locking bearings then act as latch elements by being partially received within concave locking cups 118, 120 in right insert 122 and left insert 124 in the upper receiver 12. In this locked position, the locking bearings prevent reciprocation of the bolt relative to the upper receiver. Pressure exerted on the bolt, even from the discharge of a more powerful magnum cartridge, cannot dislodge the locking bearings from the concave locking cups. In the current embodiment, the left and right inserts are made of steel to provide enhanced strength and durability compared to the aluminum used for the upper receiver.

FIGS. 4A-4E show the bolt 20 in the initially unlocked position to permit recoil just after firing. After a discharged bullet (not shown) has passed the gas port 110 in the barrel 102, a portion of the high pressure gas following the bullet exits the gas port and enters the front 114 of the gas tube 112 via a gas block 134. The gas then flows down the gas tube and exits at the rear 116 to pressurize the gas bore 66 in the gas key 56. The resulting pressure, once it is sufficient to overcome the forward pressure exerted by the firing pin spring 90, drives the gas key rearward along a key axis 132 until the rudder 68 reaches the travel limit at the rear 44 of the front guide slot 40. After the initial rearward movement of the gas key, the gas bore separates from the rear of the gas tube, thereby eliminating continued exertion of rearward force on the gas key. The high pressure gas is effectively metered from the gun barrel in that the gas key does not begin moving until a sufficient pressure is reached in the gas bore to overcome the forward pressure exerted by the firing pin spring, regardless of the firing pressure of the cartridge (even if the cartridge is a high-power magnum cartridge).

At the end of the delay imposed by the gas build up within the gas bore 66 in the gas key, the rudder 68 moves to the rear 44 limit of the front guide slot 40. The rearward motion of the gas key 56 removes the outward pressure exerted by the sear on the locking bearings 52, 54. The removal of the sear 72 enables the locking bearings to move inward perpendicularly to the gas key axis 132 from the force of the discharged cartridge acting on the bolt 20, thereby unlocking the bolt and allowing the bolt to move rearward in response to the remaining blowback pressure from the discharged cartridge.

The right angled portion 76, central flat portion 78, left angled portion 80, right groove 82, and left groove 84 of the wedge-shaped sear 72 are control surfaces that are angled to squeeze the locking bearings 52, 54 into the concave locking cups 118, 120. These surfaces provide this function whenever the gas key 56 is pushed forward to lock the bolt 20. The shallow angle of the grooves 82, 84 provide considerable locking force to the system. The steep right and left angled portions 76, 80 of the sear 72 provide minimal locking force to allow less friction of the bolt during the out of battery cycle.

In the current embodiment, the grooves 82, 84 can range from 0° to 20°, and are preferably 2.5°. The closer the groove angle is to 0°, the tighter the lock up of the bolt 20. The groove has a small taper to provide manufacturing tolerances and provide for wear from extended use. In the current embodiment, the angles 136 of the right and left angled portions 76, 80 of the sear 72 are 60°. The angle of the concave locking cups 118, 120 is 45° in the current embodiment. An increase or decrease in the angle of the concave locking cups and/or the location of the gas port 110 would affect the maximum angle of the groove and the associated lock up characteristics of the bolt.

FIGS. 5A-5D show the bolt 20 in the full recoil position. The bolt is in the rearmost position ready to eject the empty cartridge case (not shown) through the ejection port 126 in the upper receiver 12 utilizing the extractors 128. By this time, the gas has also been exhausted from the barrel 102. The bolt is then driven forward by the action of a bolt return spring system (not shown) located in the lower receiver 14, behind and in contact with the bolt. The forward movement of the bolt also enables the firing pin spring 90 to move the gas key 56 and sear 72 forward to the limit of travel imposed by contact between the rudder 68 and the front 42 of the front guide slot 40. The control surfaces 76, 78, 80, 82, and 84 on the sear then return the locking bearings 52, 54 to the concave locking cups 118, 120 as shown in FIGS. 3A-3D to secure the bolt in the locked position.

While a current embodiment of an auto-loading firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An auto-loading firearm having a blowback operating system comprising;

a frame defining a bolt passage;

a bolt within the bolt passage and operable to reciprocate therein between a battery position and a retracted position along a bolt axis;

an elongated barrel connected to the frame;

the barrel defining a gas aperture at an intermediate position along the length of the barrel;

the barrel having a chamber adapted to receive a cartridge having a case;

a gas tube having a first end communicating with the gas aperture and an opposed second end;

the bolt having a bolt body and a bolt key movable with respect to the bolt body between a forward position and a rearward position;

the bolt key operably engaging the second end of the gas tube when the bolt is in the battery position;

the gas tube is open at the opposed second end allowing gas from the gas aperture to travel through the gas tube and directly impinge upon the bolt key;

the bolt including a latch element operably engaged to the bolt key;

the latch element having a locked position in which the latch element operably engages the frame to prevent reciprocation of the bolt, and an unlocked position in which the bolt is enabled to move rearward in response to blowback pressure from the cartridge case; and the latch element being responsive to rearward motion of the bolt key to move from the locked position to the unlocked position.

2. The firearm of claim 1 wherein the latch element is a ball.

3. The firearm of claim 1 wherein the latch element includes two latch element portions that move in opposition.

4. The firearm of claim 1 wherein the frame defines a recess operable to engage the latch element when the bolt is in the battery position and the latch element is in the locked position.

5. The firearm of claim 1 wherein the bolt key is biased toward the forward position.

6. The firearm of claim 1 wherein the bolt key reciprocates along a bolt key axis parallel to the bolt axis, and wherein the latch element moves perpendicularly to the bolt axis.

7. The firearm of claim 6 wherein the bolt key includes a cam surface angularly offset from the bolt key axis and operable to laterally move the latch element as the bolt key moves forward and rearward.

8. The firearm of claim 7 wherein the bolt key includes a wedge, and the latch element includes two latch element portions, and where the wedge is positioned between the latch element portions to force the latch element portions apart from each other as the bolt key moves to the forward position.

9. The firearm of claim 1 wherein the bolt key includes a fitting operable to generate rearward motion of the bolt key in response to gas pressure in the gas tube.

10. The firearm of claim 1 wherein the latch element is in the locked position when the bolt is in the battery position when discharge energy is not being transmitted by the gas tube.

11. The firearm of claim 1 wherein the latch element being in the locked position when the bolt key is in the forward position, and in the unlocked position when the bolt key is in the rearward position.

12. The firearm of claim 7 wherein the cam surface is angularly offset at least 0° from the bolt key axis and is angularly offset no more than 20° from the bolt key axis.

13. The firearm of claim 1 wherein the bolt key is adapted to disengage from the gas tube when the bolt key is in the rearward position, such that moving the bolt key to the rearward position eliminates continued exertion of rearward force on the bolt key.

14. The firearm of claim 1 wherein a recess adapted to receive the latch element is formed in an insert received in the frame.

15. The firearm of claim 14 wherein the insert is externally threaded.

16. The firearm of claim 14 wherein the recess defines a polygonal aperture.

17. The firearm of claim 14 wherein the insert has a face recessed below an adjacent surface of the frame.

18. The firearm of claim 1 wherein a conical recess adapted to receive the latch element is formed in the frame.

19. The firearm of claim 18 wherein the conical recess comprises a linear surface contact portion adapted for contact by the latch, the linear surface contact portion is angled 45 degrees from the barrel.

20. An auto-loading firearm having a blowback operating system comprising;

a frame defining a bolt passage;

a bolt within the bolt passage and operable to reciprocate therein between a battery position and a retracted position along a bolt axis;

an elongated barrel connected to the frame;

the barrel defining a gas aperture at an intermediate position along the length of the barrel;

the barrel having a chamber adapted to receive a cartridge having a case;

a gas tube having a first end communicating with the gas aperture and an opposed second end;

the bolt having a bolt body and a bolt key movable with respect to the bolt body between a forward position and a rearward position;

the bolt key operably engaging the second end of the gas tube when the bolt is in the battery position;

the gas tube is open at the opposed second end allowing gas from the gas aperture to travel through the gas tube and directly impinge upon the bolt key;

the bolt including a latch element operably engaged to the bolt key;

the latch element having a locked position in which the latch element operably engages the frame to prevent reciprocation of the bolt, and an unlocked position in which the bolt is enabled to move rearward in response to blowback pressure from the cartridge case;

the latch element being responsive to rearward motion of the bolt key to move from the locked position to the unlocked position;

the frame defining a recess adapted to receive the latch element;

the recess having a contact surface portion adapted for contact by the latch and facing in a forward and medial angle direction;

the bolt key having a tapered latch contact surface angularly offset from the bolt axis and adapted to bias the latch against the contact surface portion; and the bolt having a rearward-facing latch biasing surface operable to limit forward movement of the latch when the bolt is in the battery position and the latch is biased by the tapered latch contact surface, such that the latch element is positionally locked by the bolt, frame, and bolt key when the bolt is in the battery position, and wherein the bolt key is adapted to release the latch element to enable movement of the bolt only in response to energy transmitted from the gas tube.

21. The firearm of claim 20 further comprising a spring operably connected between the bolt and the latch to bias the latch in a forward direction.

22. The firearm of claim 21 wherein the spring is contained within the receiver.

23. The firearm of claim 20 wherein the spring is aft of a forward portion of the bolt.

24. The firearm of claim 20 wherein the spring is mounted to the bolt and reciprocates with the bolt.

25. An auto-loading firearm having a blowback operating system comprising;

a frame defining a bolt passage;

a bolt within the bolt passage and operable to reciprocate therein between a battery position and a retracted position along a bolt axis;

an elongated barrel connected to the frame;

the barrel defining a gas aperture at an intermediate position along the length of the barrel;

the barrel having a chamber adapted to receive a cartridge having a case;

a gas tube having a first end communicating with the gas aperture and an opposed second end;

the bolt having a bolt body and a bolt key movable with respect to the bolt body between a forward position and a rearward position;

a spring operably connected between the bolt and the latch to bias the latch in a forward direction;

the spring is contained within the receiver;

the bolt key operably engaging the second end of the gas tube when the bolt is in the battery position;

the gas tube is open at the opposed second end allowing gas from the gas aperture to travel through the gas tube and directly impinge upon the bolt key;

the bolt including a latch element operably engaged to the bolt key;

the latch element having a locked position in which the latch element operably engages the frame to prevent reciprocation of the bolt, and an unlocked position in which the bolt is enabled to move rearward in response to blowback pressure from the cartridge case; and the latch element being responsive to rearward motion of the bolt key to move from the locked position to the unlocked position.

26. The firearm of claim 25 wherein the spring is aft of a forward portion of the bolt.

27. The firearm of claim 25 wherein the spring is contained within the bolt.

28. The firearm of claim 25 wherein the spring is positioned between a portion of the key and a portion of the bolt.

29. The firearm of claim 25 including a firing pin connected to the bolt and encompassed by the spring.

* * * * *